US005708629A

United States Patent [19]

Hung-Hsu

[11] Patent Number: 5,708,629

[45] Date of Patent: Jan. 13, 1998

[54] STRUCTURE OF ALARM CLOCK

[76] Inventor: Yen Hung-Hsu, P.O. Box 82-144, Taipei, Taiwan

[21] Appl. No.: 703,373

[22] Filed: Aug. 26, 1996

[51] Int. Cl.[6] ..... G04B 23/02

[52] U.S. Cl. ..... 368/73; 368/12; 368/262

[58] Field of Search ..... 368/262, 265, 368/12, 73, 315–317

[56] References Cited

U.S. PATENT DOCUMENTS 4,218,875 8/1980 Rothman ..... 368/73

4,449,833 5/1984 Mongomery ..... 368/262

*Primary Examiner*—Bernard Roskoski

*Attorney, Agent, or Firm*—Alfred Lei

[57] ABSTRACT

An alarm clock including clock having a control circuit with a solenoid switch, and a rack having an upright post with a magnet, wherein when the alarm circuit of the clock is ringing, the battery lid and the alarm button of the clock are locked if the clock is not put in the rack; when the lock is put in the rack as the alarm circuit of the clock is ringing, a solenoid switch is induced by a magnet in the rack to unlock the battery lid and the alarm button, for permitting the user to turn off the alarm.

5 Claims, 5 Drawing Sheets

FIG 1

STRUCTURE OF ALARM CLOCK

BACKGROUND OF THE INVENTION

1. Field of the Invention

This invention relates to alarm clocks, and relates more particularly to such an alarm clock which allows the user to turn off the alarm only when the clock is put in a matched rack.

2. Description of the Prior Art

An alarm clock is a clock which can be set to ring at any desired time. It is commonly used to wake a person at a particular time. Because regular alarm clocks commonly have an alarm button on the outside adapted for turning off the alarm, an alarm clock user may refuse to get up from bed and press down the alarm button to turn off the alarm when the alarm clock is ringing.

SUMMARY OF THE INVENTION

This invention relates to alarm clocks, and relates more particularly to such an alarm clock which allows the user to turn off the alarm only when the clock is put in a matched rack. According to one aspect of the present invention, the alarm clock comprises a clock, and a rack. The clock has a bottom hole. The rack has an upright post, and a magnet at the top of the upright post. When the clock is put in the rack, the upright post is inserted into the bottom hole of the clock, and the solenoid switch of the control circuit inside the clock is induced to release the alarm button, for permitting the alarm button to be operated to turn off the alarm during the ringing of the clock. According to another aspect of the present invention, a hook is turned about a peg inside the housing of the clock, and controlled by an electromagnetic valve to lock the battery lid when the clock is ringing.

DETAILED DESCRIPTION OF THE PREFERRED EMBODIMENT

Figure 1:
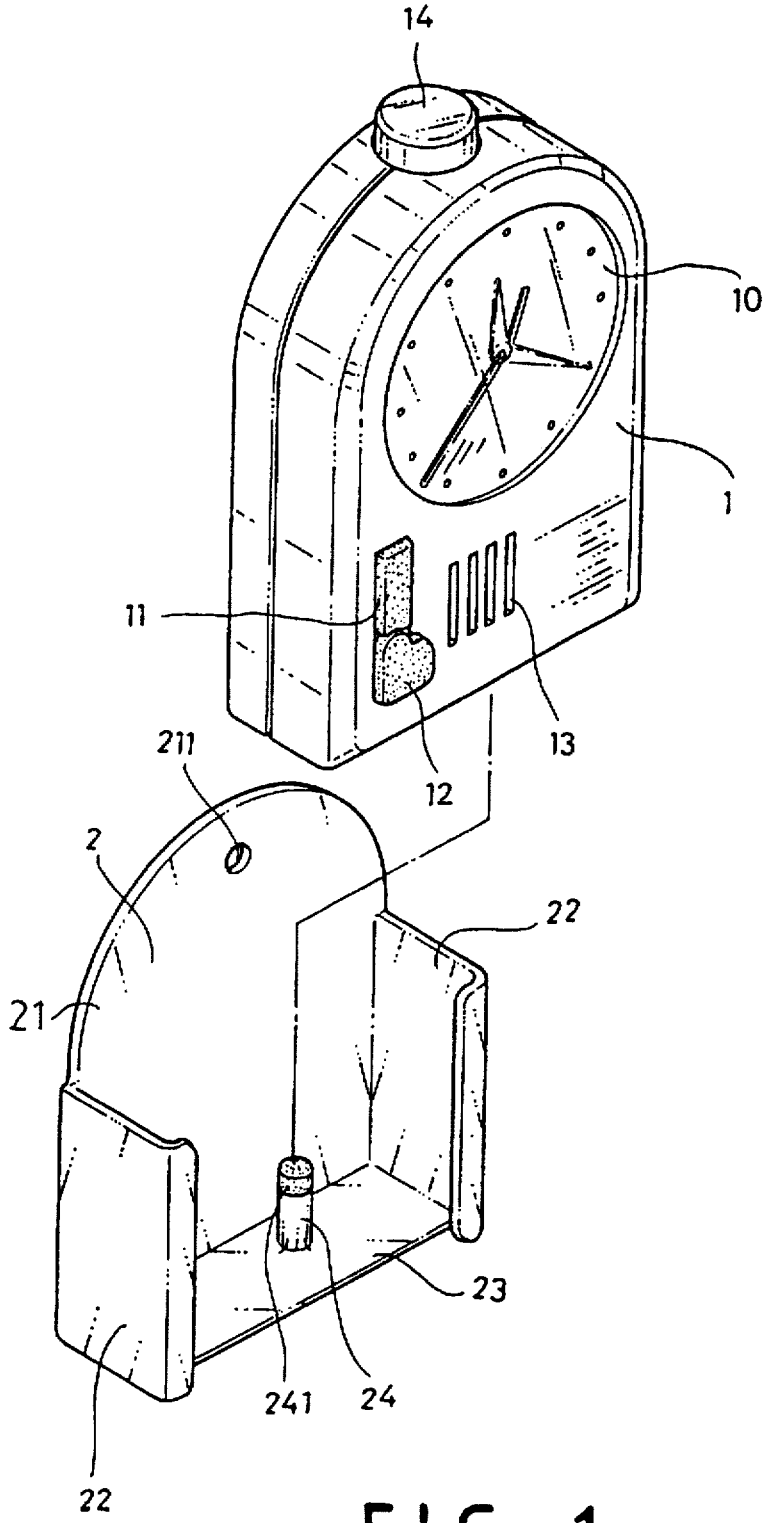
FIG. 1 is an elevational view of the present invention, showing the clock removed from the rack.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Referring to FIG. 1, an alarm clock in accordance with the present invention is generally comprised of a clock 1, and a rack 2. The clock 1 has a dial 10 at the front side, two control buttons 11, 12 and a speaker output port 13 below the dial 10, and an alarm button 14 at the top. The rack 2 comprises an upright back wall 21 having a hang hole 211 for hanging, a horizontal bottom wall 23 perpendicularly extending from the upright back wall 21 at the bottom, two upright side walls 22 bilaterally connected between the upright back wall 21 and the horizontal bottom wall 23, and an upright post 24 raised from the horizontal bottom wall 23 at the center, and a magnet 241 fixedly mounted on the upright post 24 at the top.

Figure 2:
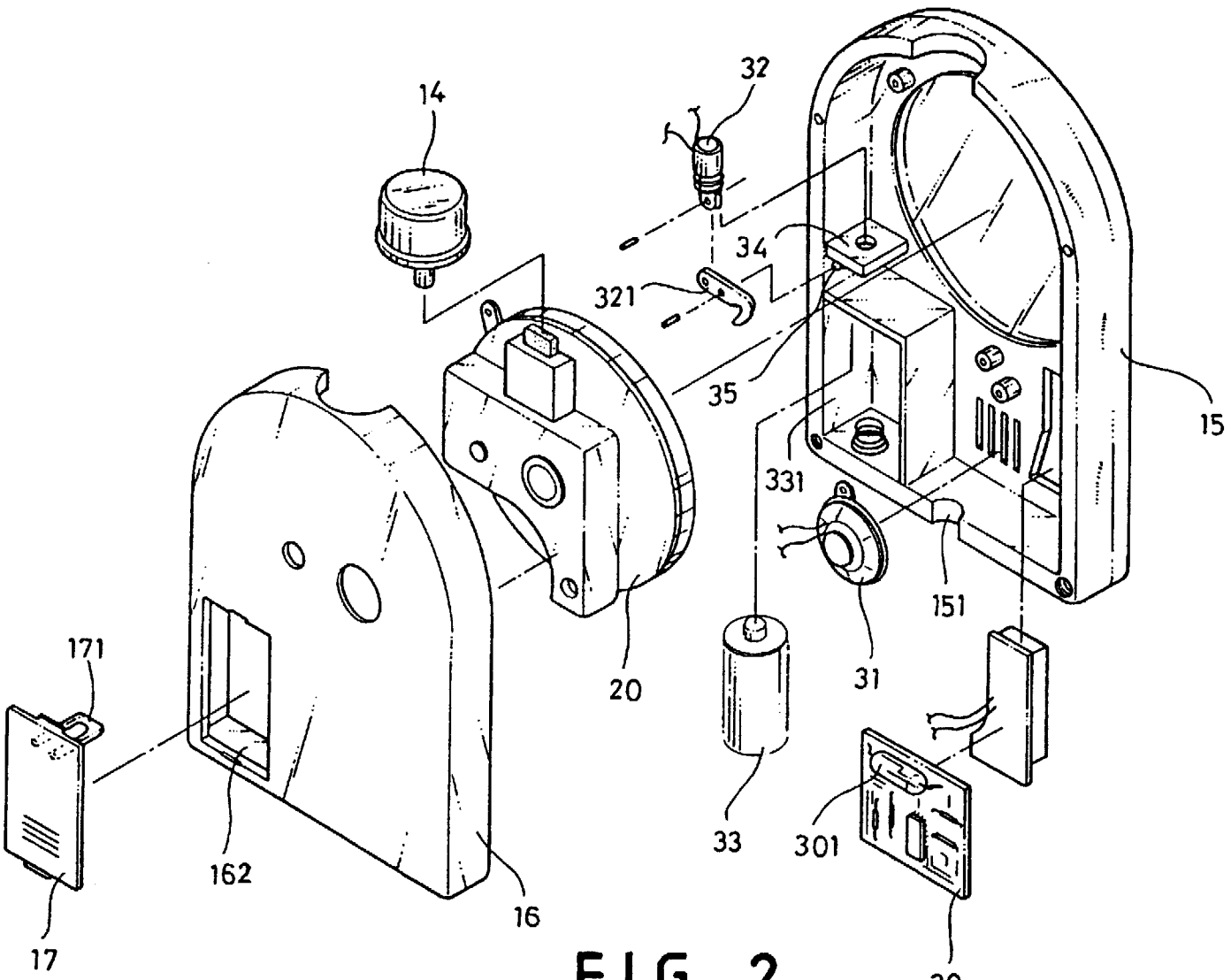
FIG. 2 is an exploded view of the clock according to the present invention.

Referring to FIG. 2 and FIG. 1 again, the clock 1 comprises a casing 15 having an electromagnetic valve holder 34 horizontally disposed on the inside, a peg 35 disposed below the electromagnetic valve holder 34, and a half-round bottom hole 151 which receives the upright post 24 of the rack 2, an electromagnetic valve 32 mounted in the electromagnetic valve holder 34 in a vertical position, a hook 321 turned around the peg 35 and having one end pivoted to the electromagnetic valve 32, a back cover 16 covered on the casing 15 at the back side and having a back opening 162 and a half-round bottom hole 161 (not shown), a battery lid 17 covered on the opening 162 and having a locating loop 171 at an inner side for engagement with the hook 321, a movement 20 and a control circuit board 30 mounted inside the casing 15, a battery case 331 defined within the casing 15 at the bottom, a battery 33 mounted in the battery case 331 and electrically connected to the control circuit board 30 and the movement 20, and a speaker 31 mounted inside the casing 15 behind the speaker output port 13 and electrically connected to the control circuit board 30. The control circuit board 30 comprises a solenoid switch 301 controlled by the magnet 241 to switch off the alarm button 14. When the back cover 16 is covered on the casing 15, the half-round bottom holes 151, 161 are matched together and form a round hole for receiving the upright post 24 of the rack 2.

Figure 3:
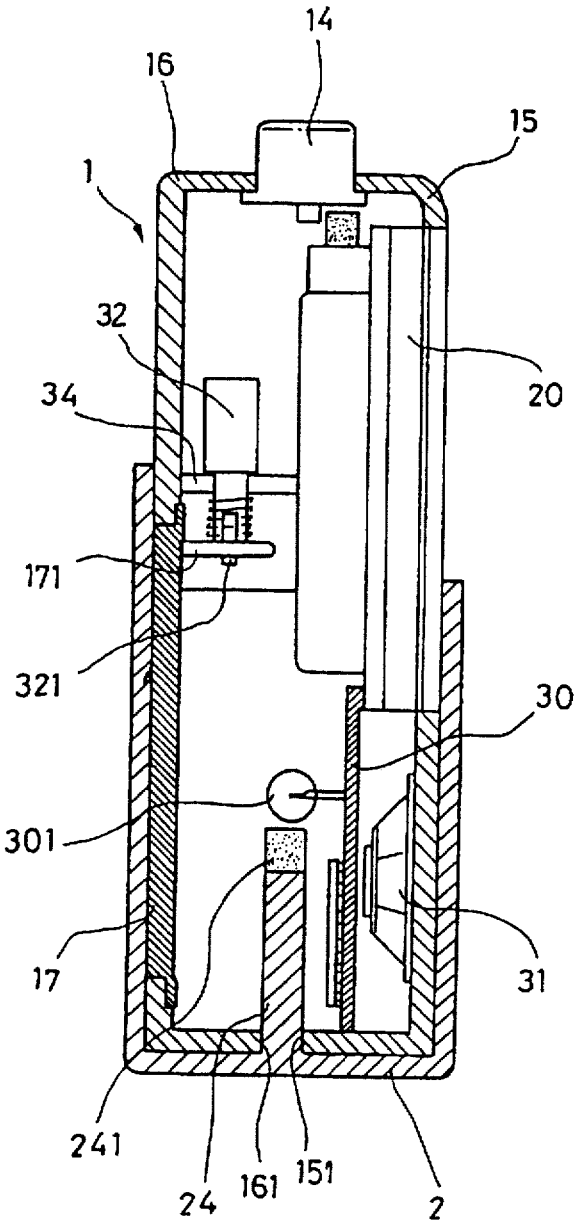
FIG. 3 is a sectional side view of the present invention, showing the clock mounted in the rack.

Referring to FIG. 3, when the set alarm time comes, the alarm button 14 cannot be switched off unless the clock 1 is mounted in the rack 2, permitting the upright post 24 to be inserted into the half-round bottom hole 151 of the casing 15 and the half-round bottom hole 161 of the back cover 16. When the upright post 24 is inserted into the bottom hole 151 of the casing 15, the solenoid switch 301 is induced by the magnet 241 to switch off the alarm button 14. When in use, the rack 2 can be mounted in the bath room, and the clock 1 can be placed on the night commode (bedside table). Therefore, when the clock 1 alarms, the user must get up from bed and put the clock 1 in the rack 2 so that the alarm of the clock 1 can be turned off. This design is practical to prohibit the user from refusing to get up from bed.

Figure 4A:
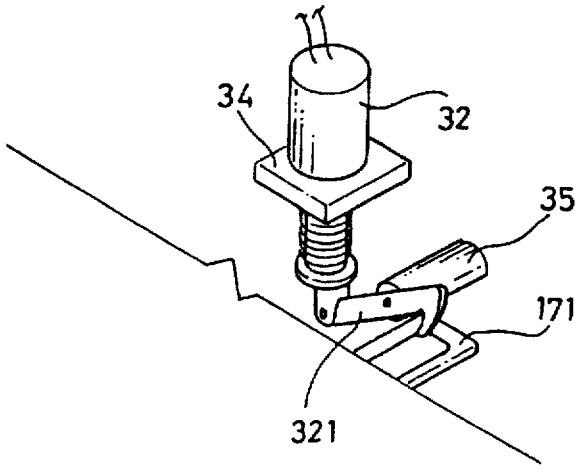
FIG. 4A is a partial view of the present invention, showing the hook turned about the peg, pivoted to the electromagnetic valve, and released from the locating loop of the battery lid.
Figure 4B:
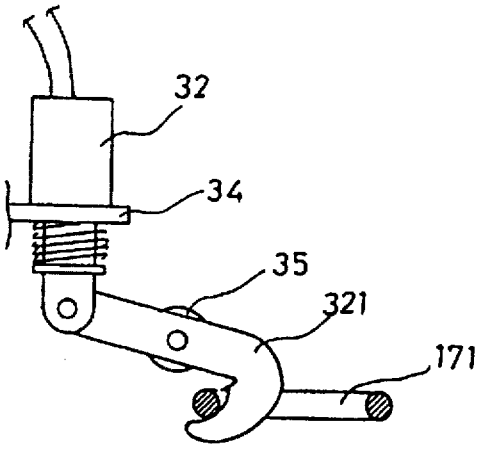
FIG. 4B is similar to FIG. 4A but showing the hook hooked on locating loop of the battery lid.

Referring to FIGS. 4A and 4B, the electromagnetic valve 32 is movably and vertically mounted in the electromagnetic valve holder 34; the hook 321 is turned about the peg 35 and having a fixed end pivoted to the electromagnetic valve 32 (see FIG. 4A). When the alarm clock alarms, the electromagnetic valve 32 is controlled (by the aforesaid control circuit board 30) to move upwards, thereby causing the hook 321 to be turned downwards and hooked on the locating loop 171 (see FIG. 4B). When the hook 321 is forced into engagement with the locating loop 171, the battery lid 17 is locked, and the user cannot open the battery lid 17 to take out the battery 33.

Figure 5:
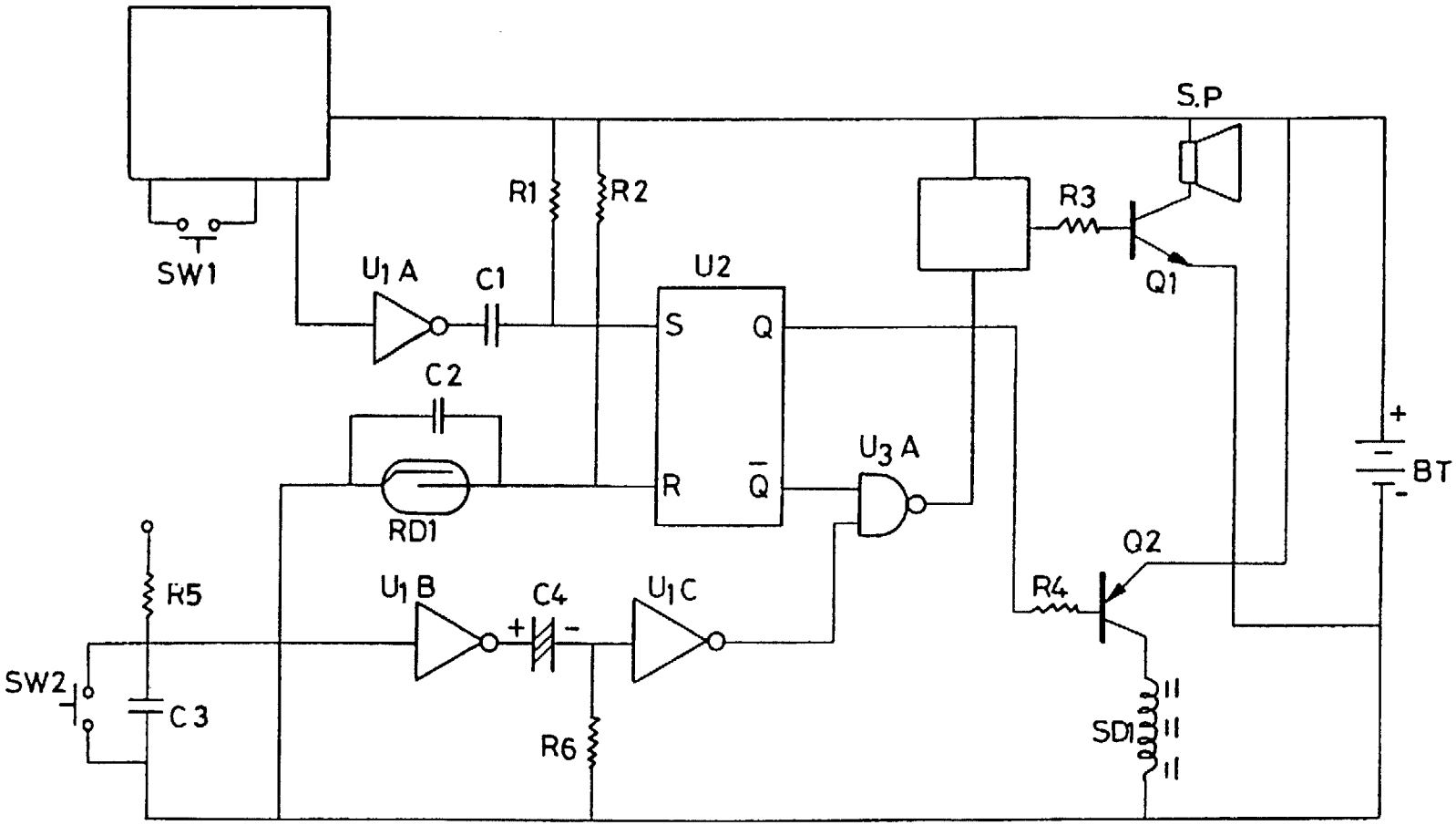
FIG. 5 is a circuit diagram of the present invention.

Referring to FIG. 5, when the set alarm time comes, the clock module (namely, the aforesaid movement 20) CM1 outputs a pulse signal to a single shot triggering circuit, which is comprised of U1A, C1, R1, and U1D, thereby causing a flip-flop U2 to work and to send a high potential signal to a voice IC U4 through U3A. When the voice IC U4 receives the high potential signal from U3A, a ring signal is produced and amplified through R3 and Q1, to a speaker S.P, causing it to produce sound. At the same time, the flip-flop U2 sends a low potential signal through R4 and Q2 to drive an electromagnetic valve SD1. When SW2 (namely, the alarm button 14) is pressed down during the alarm status, a low potential signal is sent from SW2 through UIB, C4, R6, and U1C to U3A, causing U3A to reverse the potential, therefore U3 signal is stopped, and the speaker S.P is turned off. If the user does not put the clock back to the rack, the solenoid switch RD1 is turned on to reset the flip-flop, thereby causing U3A to provide a low potential output, therefore U4 is driven to provide a ring signal to drive the speaker again.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An alarm clock comprising a housing, a clock module and a control circuit mounted inside said housing, and a rack adapted for receiving said clock, said control circuit comprising a solenoid switch, said clock module comprising an alarm circuit, said housing comprising a casing and a back cover covered on said casing, said casing comprising a battery case, which holds a battery, which is electrically connected to said clock module and said clock control circuit, an electromagnetic valve holder suspending above said battery case, a peg spaced between said electromagnetic valve holder and said battery case, an electromagnetic valve mounted in said electromagnetic valve holder, a hook turned about said peg and having a fixed end pivoted to said electromagnetic valve and a hooked free end, and a bottom hole, said back cover comprising a back opening, a battery lid covered on said back opening and having a locating loop at an inner side, a bottom hole matched with the bottom hole of said casing, said rack comprising an upright back wall having a hang hole for hanging, a horizontal bottom wall perpendicularly extending from said upright back wall at the bottom, two upright side walls bilaterally connected between said upright back wall and said horizontal bottom wall, and an upright post raised from said horizontal bottom wall at the center, and a magnet fixedly mounted on said upright post at the top, wherein when a set alarm time comes and said housing is disconnected from said rack, the alarm circuit of said clock module is driven by said control circuit to alarm, and said electromagnetic valve is simultaneously driven by said control circuit to turn said hook, causing said hook to hook up the locating loop of said battery lid; when said housing is put in said rack by inserting the upright post of said rack into the bottom hole of said casing and the bottom hole of said back cover during the ringing of said clock module, said solenoid switch of said control circuit is induced to turn off the alarm circuit of said clock module, and to cut off power supply from said electromagnetic valve, causing said hook to be released from the locating loop of said battery lid.

2. The alarm clock as claimed in claim 1 wherein said upright post of said rack has a polygonal cross section fitting the hole formed of the bottom hole of said casing and the bottom hole of said back cover.

3. The alarm clock as claimed in claim 1 wherein said upright post of said rack has a triangular cross section fitting the hole formed of the bottom hole of said casing and the bottom hole of said back cover.

4. The alarm clock as claimed in claim 1 wherein said upright post of said rack has a star-like cross section fitting the hole formed of the bottom hole of said casing and the bottom hole of said back cover.

5. The alarm clock as claimed in claim 1 wherein said clock module has an alarm button at a top side thereof projecting out of a top hole in said housing, and adapted for stopping the said alarm circuit from alarming.

* * * * *